United States Patent [19]

Mar et al.

[11] 4,097,834

[45] Jun. 27, 1978

[54] NON-LINEAR RESISTORS

[75] Inventors: Kenneth M. Mar, Tempe; Kim Ritchie, Phoenix; James N. Smith, Tempe, all of Ariz.

[73] Assignee: Motorola, Inc., Schaumburg, Ill.

[21] Appl. No.: 676,268

[22] Filed: Apr. 12, 1976

[51] Int. Cl.[2] ..... H01C 7/10

[52] U.S. Cl. ..... 338/21; 29/610 R; 252/512; 252/514; 252/518

[58] Field of Search ..... 338/20, 21; 29/621, 29/610, 620; 252/518.3; 357/28, 59

[56] References Cited

U.S. PATENT DOCUMENTS

| | | | |
|---|---|---|---|
| 3,017,520 | 1/1962 | Maupin | 307/88.5 |
| 3,286,138 | 11/1966 | Shockley | 357/28 |
| 3,474,304 | 10/1969 | Currin et al. | 357/40 |
| 3,564,353 | 2/1971 | Corak et al. | 338/20 X |
| 3,857,174 | 12/1974 | May | 29/621 |
| 3,916,366 | 10/1975 | Jefferson | 338/21 |

FOREIGN PATENT DOCUMENTS

| | | | |
|---|---|---|---|
| 11,873 | 4/1972 | Japan | 338/21 |

*Primary Examiner*—C. L. Albritton
*Attorney, Agent, or Firm*—Lowell E. Clark

[57] ABSTRACT

Non-linear resistors for use as protective devices in electronic circuits. Compositions and methods are disclosed which enable the fabrication of non-linear resistors compatible with other electronic devices in monolithic form. The non-linear resistors disclosed also offer improvements over prior art devices as discrete components.

4 Claims, 1 Drawing Figure

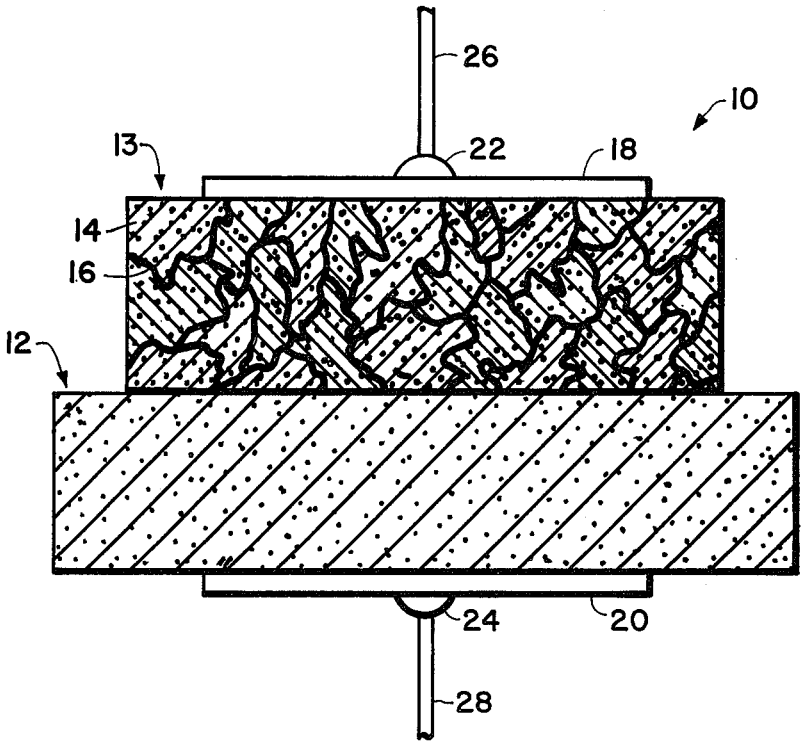
26
10
13
22
18
14
16
12
24
20
28

NON-LINEAR RESISTORS

BACKGROUND OF THE INVENTION

This invention relates to electronic compositions, and more particularly, to non-linear resistors and a process thereof.

The non-linear resistors to which this invention is directed are resistors wherein current is non-linear with respect to applied potential at any given temperature. The simplified volt-ampere characteristics of a non-linear resistor are represented by the empirical relationship $$I = K V^{\alpha}$$

where $I$ is the current flowing through the resistor, $V$ is the absolute value of the voltage across the resistor, $\alpha$ (alpha) is a number greater than one and $K$ is a constant. Such symmetrical non-linear resistors are used in a wide variety of applications to stabilize voltage or current in electrical circuits. For example, many electronic components, such as transistors, require protection against overvoltage surges. When a non-linear resistor is connected in parallel with such components, it will absorb the overvoltage surge thereby protecting the component.

Various devices have been used in the electronics industry as non-linear resistors. For example, conventional zener diodes are often employed but such devices are subject to several drawbacks. Thus, not only are they costly per unit, but their voltage-current characteristics are asymmetrical, requiring two devices for each AC application.

Silicon carbide devices, made by sintering silicon carbide with an appropriate binder, have also been used in the industry. However, it has not been possible to manufacture silicon carbide devices having a suitable combination of electrical properties.

Recently sintered zinc oxide non-linear resistors have been disclosed; typical are those described in U.S. Pat. Nos. 3,503,029; 3,663,458; 3,760,318. While functional for discrete applications, the high material and processing costs involved in manufacturing such devices have limited their applications.

Still another approach to non-linear resistors is the thick film technique based on vanadium or iron oxides as described in U.S. Pat. Nos. 3,622,523; 3,836,340 and 3,900,432. However, this technique is limited to hybrid ceramics technology. Accordingly, there is still a need for a low cost, reliable non-linear resistor for use in protecting electronic components.

SUMMARY OF THE INVENTION

Now it has been found in accordance with this invention that non-linear resistors can be provided without high temperature processing by providing a layer of a composition comprising a conductor or semiconductor and a dielectric material on a substrate. Resistors made from these compositions have been found to be economical and extremely reliable in operation.

Furthermore, these resistors are not limited to discrete applications, but can be fabricated directly into the integrated circuit during the wafer processing operations. More particularly, the non-linear resistors provided in accordance with this invention comprise a layer of grains of conductor material surrounded and bound together by dielectric material on a semiconductor substrate.

BRIEF DESCRIPTION OF THE DRAWINGS

The FIGURE depicts a partly cross-sectional view of a non-linear resistor in accordance with this invention.

DETAILED DESCRIPTION OF THE INVENTION

More in detail, the compositions utilized in this invention contain at least one conductor material and at least one dielectric material.

Exemplary conductor materials include zinc, nickel, copper, aluminum, gold, platinum, tin, silver, nickel, beryllium, indium, tungsten, vanadium, silicon, selenium, gallium, graphite, nickel oxide, copper oxide, zinc oxide, aluminum oxide, vanadium oxide, gold oxide, silver oxide, beryllium oxide, indium oxide, tungsten oxide, selenium oxide, gallium oxide, tantalum oxide, iron germanium oxide, iron titanium oxide, niobium oxide, cross-linked chalcogenides, gallium arsenide, indium phosphite, indium antimonite, and mixtures thereof.

Typical of the cross-linked chalcogenides useful as the conductor material include germanium-antimony-selenium (Ge—Sb—Se), germanium-arsenic-selenium (Ge—As—Se), arsenic-selenium-tellurium (As—Se—Te), silicon-germanium-arsenic-tellurium (Si—Ge—As—Te), arsenic selenide-arsenic telluride ($As_2Se_3$—$As_2Te_3$) and thallium selenide-arsenic telluride ($Tl_2Se$—$As_2Te_3$). These chalcogenides can comprise a wide range of moles of the individual elements and are readily provided by standard phase changes by freezing a solid solution of the mixture. Preferably, the conductor material is employed in a particle size range of 3–120 $\mu$. Illustrative dielectric materials are selected from the group consisting of organic dielectric materials, glass-forming inorganic oxides, silicon nitride, boron nitride and mixtures thereof.

Suitable organic dielectric materials include epoxy polymers, polyimides, polyesters, polyisoprenes and other polymers having physical stability and current conductivity under the device operating conditions. Illustrative glass-forming oxides are $SiO_2$, $Bi_2O_3$, $K_2O$, CaO, MgO, BaO, SrO, ZnO, $Ga_2O_3$, $B_2O$, $Ta_2O_5$, $RuO_2$, $TiO_2$, $GeO_2$, $MoO_3$, $Al_2O_3$, PbO, CdO, $Na_2O$, etc. Mixtures of two or more oxides can also be used.

Other ingredients can also be included in the compositions. For example, boron, sulfur compounds, fluorine and fluorine compounds, etc.

The compositions are prepared by admixing the desired components with a liquid vehicle. Preferably 40–95% by weight of the conductor material and 5–60% by weight of the dielectric material is employed. The solids content of the resulting composition is dependent upon the method of applying the composition to the semiconducting substrate. Generally, from one to four parts by weight of solids (conductor and dielectric) per part by weight of vehicle will be employed to produce the desired consistency where a silk-screen technique is used. Also, solutions can be prepared and indeed are preferred for thin film applications for high resolution, fine geometry devices.

Any inert liquid can be suitably employed as the vehicle. For example, water or organic materials such as alcohols, ethyl cellulose, esters, solutions of resins in alcohol, glycols, polyglycols, hydrocarbons, etc. Additives can be employed if desired. Thus, thickening agents, stabilizing agents, etc. can be used.

The composition is then readily coated onto the semiconductor substrate either by painting, silk-screening, spraying or spinning. Preferably spinning techniques are employed where the composition is applied from a solution. Thus, several drops of the solution of semidconductors oxide and dielectric material are disposed on the surface of the substrate and the substrate spun at high speed to form a uniform film. While the speed and time of spinning will depend upon the dimensions of the substrate, a recommended speed for 2–3 inch diameter substrate is 3000–8000 rpm for a duration of 6 to 20 seconds.

The substrate bearing the liquid composition is then dried at a pre-bake temperature of about 200°–450° C to insure elimination of the liquid vehicle. This prebake step may be eliminated but is preferred to prevent any inadvertent splattering.

Following the pre-bake the substrate is heated at an appropriate temperature, normally from about 200°to 1100° C for a sufficient period of time to provide a glassy layer on the substrate.

Additives to the liquid composition can be employed if desired to provide special effects. For example, photosensitive compositions can be added. Such compositions comprise a photosensitive polymer optionally including glass particles. Both negative and positive photosensitive materials can be used. The use of photosensitive materials allows the resultant layer to be patterned, in accordance with normal semiconductor processing techniques. Alternately, photolithographic techniques can be used to pattern the layer formed in accordance with this invention in a subsequent step.

Semiconductor materials such as doped silicon and germanium are preferred as substrates in the practice of this invention. One of the advantages of the invention described herein is the fact that low grade silicon substrates can be employed.

While the layer of conductor and dielectric material is preferably applied directly to the semiconductor substrate, it could be removed therefrom by other materials. For example a polysilicon gate electrode in an integrated circuit could be used as the substrate for the layer of conductor material.

The dimensions of the resulting non-linear resistor are not critical. However, generally a layer about 1000Å–6000Å thick of conductor material bound by dielectric material is provided on a substrate where solution is employed while a layer 50 to 100 mils is employed where a slurry is used. The thickness of semiconductor substrate is not critical but can range from about 9 to about 20 mils.

Preferably the surfaces of the resultant body are lapped with an abrasive powder such as silicon carbide, in order to control voltage and insure good contacts.

One embodiment of this invention is illustrated in FIG. 1 wherein 10 depicts a completed discrete non-linear resistor made according to this invention. After heating as described above, the substrate 12 has formed thereon layer 13 comprising discrete particles of conductor material 14 surrounded and bound together by a phase of melted and coalesced dielectric material 16. The particles 14 function as electrodes for the film interface 16, forming a matrix of series and parallel combinations.

Metal electrodes 18 and 20 are then applied to the top and bottom surfaces respectively of the resistor assembly 10 by conventional techniques. For example, a film of Ag, Cu, Ni, Zn, Sn can be plated onto the body or a vacuum evaporated film of Al, Zn, Sn can be provided. Alternately, a metallized film of Cu, Sn, Zn or Al can be applied. Then leads 26 and 28 are applied by using a conventional solder 22 and 24, and the device is provided with a protective housing (not shown) in a conventional manner.

The non-linear resistors according to this invention offer surprising and unexpected advantages over the prior art. For example, the use of high pressure presses with the attendent economic disadvantages is avoided.

While any of the aforementioned compositions can be utilized to provide non-linear resistors, preferred compositions comprise 69 to 71% by weight of silicon particles having a particle size of from 5 to 125$\mu$ and 29 to 31% by weight of glass forming inorganic oxides. By "silicon particles" it should be understood is meant semiconductor silicon, i.e., doped silicon. Either p-doped or n-doped silicon can be employed; these materials are well known and are described in Fundamentals of Integrated Circuits by Lothar Stern, Hayden Book Company, Inc., New York, 1968. These compositions offer the additional advantages of controlling $\alpha$, V and the surge protecting characteristics of the device by simple modification of the dopant concentration of silicon while holding other parameters, such as thickness of the substrate and layer, conductor material particle size and dielectric material thickness as constants.

While the resistors thus formed tend to have electrical characteristics in conformance with the equation $I=KV^{\alpha}$, the most useful devices for shunt protection applications are those with high $\alpha$'s, above four for example. For high $\alpha$'s, the foregoing equation results in a current which increases very rapidly at a characteristic voltage, often called the breakdown voltage. For a given resistor material, this characteristic voltage is just proportional the resistor thickness between the electrodes, while the current at any given voltage is just proportional to the cross-sectional area. Thus, in the examples that follow the non-linear resistors are characteized by a breakdown voltage measured at 0.1 mA across a sample of specified geometry.

The following examples will serve to illustrate the practice of this invention.

EXAMPLE I

A mixture of 70 ml ethyl alcohol, 40 ml tetrabutyltitanate, 55 ml ethylacetate, 30 ml tetraorthosilicate, 16 ml pentaethyltantalate and 10 drops hydrochloric acid was spun onto a 0.001 Ω-silicon wafer at 8000 rpm for 20 sec and the wafer pre-baked at 450° C for 20 minutes in a nitrogen ambient. Additional mixture was spun-on and pre-baked twice again, resulting in a 3000Å thick layer on the substrate. High-temperature densification was carried at for a total time of 3 hours at 1100° C with an oxygen ambient for 0–60 minutes and the balance of the time in a nitrogen ambient. Ten thousand Angstroms of sputtered Al—Si were applied to both the resistor film and the opposite side of the silicon wafer; photoresist-masked etching was used to delineate a 0.040 × 0.040 inch array of resistors. The breakdown voltage was found to be 5 to 50 volts, increasing with the amount of oxygen time in the densification cycle at 1100° C.

EXAMPLE II

Same as Example I, except the 16 ml of pentaethyltantalate was omitted from the solution. Electrical results were very similar.

EXAMPLE III

A mixture of 10 ml $H_2O$, 1–2.5 gm $ZnCl_2$, 40 ml ethanol, 30 ml methanol, 20 ml ethylacetate, 20 ml tetraethylorthosilicate, 8 mg BiOCl, and three drops of concentrated HCl, was spun onto a 0.001 Ω-cm silicon wafer at 6000 rpm for 20 sec and the wafer and solution were prebaked at 450° C for 20 minutes in a nitrogen ambient. This process was iterated twice, and high temperature annealing was carried out for 5 to 60 minutes in an oxygen ambient. Metal contacts were applied and patterning was effected as in Example I. The breakdown voltage was found to be 5 to 50 volts depending on the annealing time.

EXAMPLE IV

A resistor composition was made by mixing 70% by weight of 45–125 μ n-silicon particles doped at $1\times10^{17}$ atoms/cc with 30% by weight of particles of a glass composed of 50% PbO, 40% $SiO_2$, and 10% $Al_2O_3$. *Then* 2.5 parts by weight of this resistor composition was mixed with one part by weight of a negative polyisoprene-based photoresist sold by Hunt Chemical Co. as Waycoat SC. The resulting paste was diluted to 1000–2000 cps viscosity with xylene and spun to a thickness of 0.030 inches on a 0.001 Ω-cm silicon wafer at 5000 rpm and heated gradually to remove the organics.

Then the material was fired at 910° C for 10 minutes. After lapping with silicon carbide particles, a Ag electrode paste was applied and the wafer sawed into ½ inch squares. The 0.1 mA breakdown voltage was 85 volts.

EXAMPLE V

Same as Example IV except that Dupon Elvacite 2044 was used as a binder in place of the photoresist. The conductor/dielectric/binder weight ratio was 2/1/.06.

A 0.035 inch thick resistor of this material gave 105 volts breakdown.

EXAMPLE VI

Same as Example V except that 5–10μ particles of $1\times10^{17}$ $cm^{-3}$ n-doped silicon particles were used as the conductor. A 0.035 inch thick film gave a breakdown voltage of 400 volts.

EXAMPLE VII

Same as Example IV, except film thicknesses of 30, 40, 50 and 60 mils were prepared. The resulting breakdown voltages were 85, 130, 170 and 200 volts.

EXAMPLE VIII

A mixture of three parts by weight copper particles to one part of Dupon 35 (polymerized Diallyl Phthalate resin) was diluted with methylethyl ketone to a viscosity of 1000–2000 cps and spun to a thickness of 50 mils on a silicon wafer. The temperature was increased slowly to 245° where the mixture was held for 1 hour. Ag paste was used to apply leads; the breakdown voltage for a ½ inch square sawed resistor was 44 volts.

EXAMPLE IX

Same as Example II except $2\times10^{15}$ $cm^{-3}$ boron-doped silicon particles were used and thickness was 0.035 inches. The breakdown voltage was 150 but the breakdown was not as sharp as with the heavier doped silicon particles.

In general, the use of smaller silicon particles was found to increase the breakdown voltage for a given thickness of resistor, but making the particles too large to get a low voltage resulted in less uniform bodies when the spin-on technique was used. Because there were fewer intergrannular boundaries, current density was inhomogeneous and power dissipation capability was low. Likewise, use of too high a doping in the silicon particles resulted in low current capability, while low doping gave higher voltages with a softer breakdown (i.e. lower $\alpha$).

What is claimed is:

1. A non-linear resistor comprising:

a semiconductor substrate having a first surface and a second surface;

a thin layer of non-linear resistive material comprising a mixture of 40% to 95% by weight of a conductor material and 5% to 60% by weight of a dielectric material disposed on said first surface.

2. The non-linear resistor of claim 1 where said thin layer is 1000Å–6000Å thick.

3. A non-linear resistor according to claim 1 wherein said semiconductor substrate is silicon.

4. A non-linear resistor according to claim 3 wherein said conductor material is silicon.

* * * * *